United States Patent [19]

Prohoroff

[11] 4,009,724

[45] Mar. 1, 1977

[54] AIR VENT PARTICLE FILTER CAP

[75] Inventor: Jack P. Prohoroff, Orange, Calif.

[73] Assignee: Armando C. Hernandez, Anaheim, Calif.

[22] Filed: Aug. 18, 1975

[21] Appl. No.: 605,274

[52] U.S. Cl. ..... 131/187; 131/210

[51] Int. Cl.[2] ..... A24F 13/02

[58] Field of Search ..... 131/187, 189, 201, 210, 131/211, 212

[56] References Cited

UNITED STATES PATENTS

| | | | |
|---|---|---|---|
| 2,954,774 | 10/1960 | Lebert | 131/201 X |
| 2,954,779 | 10/1960 | Lebert | 131/187 |
| 3,472,238 | 10/1969 | Blount et al. | 131/187 |
| 3,612,064 | 10/1971 | Woods | 131/201 X |
| 3,636,960 | 1/1972 | Blount et al. | 131/201 X |

*Primary Examiner*—Stephen C. Pellegrino
*Attorney, Agent, or Firm*—Grover A. Frater

[57] ABSTRACT

An improved filter cartridge for use in cigar and cigarette holders is formed by a cylindrical cup having an inlet perforation in its side wall and a barrier wall extending from the bottom wall of the cup past and closely adjacent to the inlet perforation. The cartridge is used with a cigar or cigarette holder of the type having an internal cavity in which the cartridge is disposed and having conformations with which the open end of the cartridge interfits such that the flow of smoke proceeds from the cigarette recess of the holder to the cavity surrounding the cartridge and then through the inlet perforation against and past the barrier at the interior of the cartridge.

4 Claims, 7 Drawing Figures

AIR VENT PARTICLE FILTER CAP

BACKGROUND OF THE INVENTION

This invention relates to filter elements of the kind that are incorporated in a cigar or cigarette holder and which rely on acceleration and deceleration of smoke through a labrynth to condense and entrap tars and other nicotine bearing constituents of cigarette smoke.

The invention provides an improved filter cartridge for use with cigar and cigarette holders such as the holder shown in the U.S. Pat. No. 3,472,238.

SUMMARY OF THE INVENTION

It is an object of this invention to provide an improved filter cartridge for use with a cigar or cigarette holder of the kind that has a recess at its upstream end of size to receive the end of a cigarette, and a bit at tis downstream end, and which is formed with a cavity intermediate its ends which communicates with the recess, and with a draw passage for smoke that extends through the holder from that cavity to an opening at the bit. In preferred form, the cartridge of the invention is cup-shaped and adapted to be held in the cigarette holder by conformations on the interior surface of the holder, preferably by a nipple that fits partly within the cup so that the cup is held with its axis coincident with the axis of the holder. The cup is held such that its exterior surface is in communication with the cigarette receiving recess and so that the interior of the cup is in communication with the draw passage.

It is an object of the invention to provide a filter cartridge which can be easily manufactured by molding it as a single unitary structure of plastic material whereby it can be produced at lower cost and with greater dimensional uniformity than has been possible with previous filter cartridges of its class.

Small passage openings, baffles, and expansion chambers have been combined with considerable success in smokers' withdrawal kits in which a quantity of ambient air is admitted to the smoke flow path upstream from the accelerating openings and the associated baffles. This invention is the product of an attempt to utilize those structural features to accomplish removal of the major portion of tars and nicotine from cigarette smoke passing through the filter without the aid of pre-cooling by admission of ambient air, and in such a way that the tars and nicotine are collected in the interior of a cartridge that can be removed and disposed of without soiling the user's fingers. To accomplish these results is another object of the invention.

These several objects, and other objects and advantages of the invention which will hereinafter become apparent, are realized, in part, by the provision of a cartridge which is generally cup-shaped, having a cylindrical side wall and an imperforate end wall. Smoke is admitted to the interior of the cup through a pin hole formed in the side wall. Immediately upon entering the cup, the smoke stream impinges upon a baffle wall the central area of one side of which is placed opposite the pin hole. The side of the baffle which faces the pin hole is closely adjacent to the pin hole and its area is many times greater than the pin hole. In the preferred form of the invention, the baffle wall is formed integrally with the cup and extends from the bottom wall of the cup such that the surface which faces the pin hole is substantially perpendicular to the central axis of the cup.

That front face may be tilted slightly so that its spacing from the inner wall of the cup is slightly less in the region of cup bottom. That construction called "draft" facilitates removal of the tool by which the cartridge is molded. However, any draft is slight in the preferred embodiment because performance of the filter is improved if the baffle is arranged so that air flow from the baffle proceeds rather uniformly in all directions over the surface of the baffle from the point of impingement of the incoming smoke.

The baffle is formed as a wall, and in the preferred embodiment, it is relatively thin wall so that the baffle occupies only a small portion of the interior volume of the cup. In the preferred form, the rear face of the wall is parallel with the axis of the cup and is substantially flat. The forward face of the wall, the face toward the smoke inlet perforation, is arcuate in the preferred embodiment so that there is uniform spacing between all portions of that forward face of the baffle and the inner surface of the cup. The arcuate surface is preferred so that the forward surface of the baffle may be placed closely adjacent to the pin hole without restricting the flow area past the side edges of the baffle wall. If that area is restricted unduly a disproportionate amount of flow will proceed in the direction of the length of the cup over the top edge of the baffle wall. Nonetheless, baffle walls whose forward faces are flat and lie in a plane that is perpendicular to a line that extends through the axis of the cup and through the perforation fall within the invention.

In the preferred form in which the forward face of the barrier wall is arcuate, the width of the wall is such that it extends over a 45° to 90° segment of a circle having its axis coincident with the axis of the cup. However, if the forward face of the barrier wall is flat, it is preferred that the width of the wall extend over a similarily measured angle of 45° to 60°.

The space within the cup serves as an expansion chamber and the inlet perforation and the baffles are placed to insure the expansion of the smoke and the swirling such that virtually all of the tars and nicotine will be condensed and will be caused to impinge upon the interior wall of the cup or the rear of the baffle wall after passing by the forward surface of the baffle. A purpose of the baffle and cup arrangement is to insure that the filtering action will be substantially complete over a wide range of inhalation suction pressures. When inhalation suction is very light, tars tend to collect on the inner surface of the cup and on the baffle at points near the inlet pin hole. When inhalation suction is heavy, the tars tend to be deposited at points removed from the pin hole. As a consequence, the invention permits substantially complete filtering over a wide range of inhalation suction pressure, and the deposition of tars occurs at the inside of the cup over the whole range of suction pressures.

While not important to the function of the filter cartridge, one of the objects in creating this cartridge was to provide one whose ornamentation would encourage its sale and its use. Accordingly, another object of the invention is to provide a cartridge having an ornamental appearance which does not interfere with its function as a cigarette tar and nicotine filter.

For convenience, the term "cigarette" is used herein to mean cigars and cigarettes.

Certain preferred froms of the invention are illustrated in the accompanying drawing, it being understood that other embodiments of the invention are possible and that the invention is to be measured by the appended claims.

Figure 1:
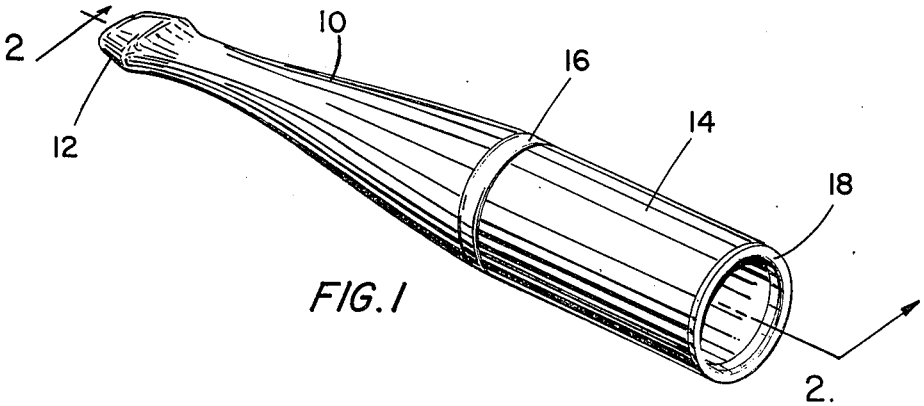
FIG. 1 is an isometric view of a cigarette holder which contains a filter cartridge.

The cigarette holder of FIG. 1 is conventional in appearance. It comprises a shank 10 which terminates at its downstream end at a bit 12 which the user holds between his teeth. The shank is attached to the downstream end of a body portion 14. In the preferred embodiment, both the shank and the body are formed of plastic. They are separated by an annular trim piece 16 which is simply a washer of plastic. Another trim piece 18 at the upstream end of the holder is formed of metal in this embodiment. It comprises a short cylindrical sleeve which is press-fitted into the end of the holder and an integral, outwardly extending flange which overlies the forward rim of the body 14.

Figure 2:
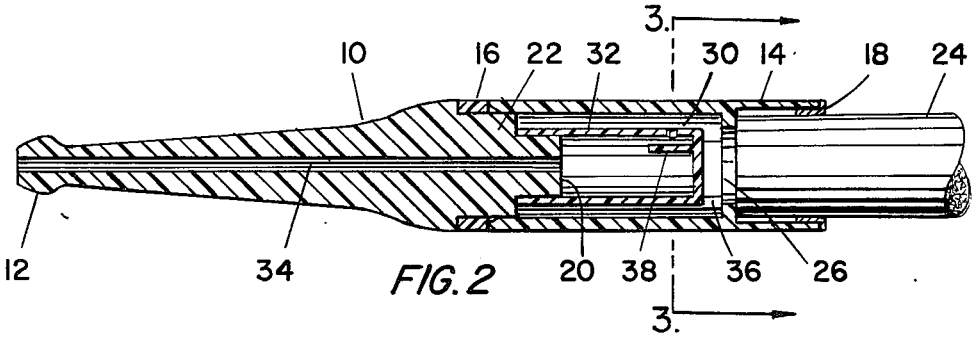
FIG. 2 is a cross-sectional view taken on line 2—2 of FIG. 1 and which includes a filter cartridge according to the invention.

The upstream end of the shank 10 is formed with conformations that interfit with the downstream end of the body 14 and with the filter cartridge. In this case, those conformations include shoulders that define a nipple 22 upon which the body 14 has sliding fit. The body is easily removed from the shank by twisting and pulling it free of the nipple. Removing the body exposes the filter cartridge to view. The filter cartridge is a cup-shaped member whose open end has a sliding fit on another conformation which, in this case, is an inner nipple 20 at the forward end of the shank 10 as best shown in FIG. 2. The nipple 20 is superimposed on the nipple 22.

The body 14 is generally cylindrical. Its forward or upstream end is adapted by being recessed to receive the end of the cigarette such as the cigarette 24. A preferred embodiment includes an inwardly extending annular flange 26 near the forward end of the body which serves to limit the degree of insertion of cigarettes. Whether that inner flange is included or not, the upstream portion of the interior of the body is here called a "recess," or "cigarette recess," and its function is to accommodate the end of a cigarette and to hold the cigarette so that it extends in the direction of the access of the holder and to serve as the entry point for cigarette smoke. That portion of the interior of the body between the cigarette cavity and the forward portion of the shank 10 is called a "cavity," or "filter cartridge cavity," and it is identified in FIG. 2 by the reference numeral 30. When the filter cartridge 32 is assembled on the shank nipple 20 it extends forwardly, or upstream, of the shank 10 such that its axis is substantially coincident with the central axis of the shank. When the body 14 is assembled on the shank by slipping its downstream margin over the cylindrical nipple 22, the filter cartridge 32 is disposed within the cavity 30 so that its axis is substantially coaxial with the body 14.

The shank 10 is provided with a draw passage 34 which is formed through the shank and opens at its upstream in the forward face of the nipple 20 and at its downstream end at the bit 12. Thus, in the assembled condition shown in FIG. 2, the interior of the filter cartridge is in communication with the draw passage 34. The exterior surface of the filter cartridge is spaced from the interior wall of the body 14. It cooperates with that interior wall to define an annular cavity through which the exterior surface of the filter cartridge is in communication with the cigarette recess identified in FIG. 2 by the reference numeral 36.

The filter cartridge is formed with at least one perforation in its side wall to complete a flow path from the cigarette recess 36 through the cavity 30 and the perforation in the side wall of the filter cartridge and then through the draw passage 34 to the bit 12. The cavity 30 serves as a storage chamber for smoke drawn through the cigarette 24 and into the cavity 30 as an incident to the preceding inhalation. In a succeeding inhalation, smoke is drawn from the cavity 30 through the perforation in the filter cartridge. That perforation is no more than a pin hole. As a consequence, the velocity of the smoke is greatly increased and it is compressed. Upon being drawn through the perforation, the smoke expands and cools. The tars and nicotine in the smoke are condensed as a consequence of that cooling. The baffle forces a change in flow direction of the smoke and the condensate. It is placed closely adjacent to the pin holes and the baffle surface is arranged so that expansion and cooling is postponed until after the smoke has been made to change direction and is proceeding radially away from the opening. In all three forms of filter cartridges shown in the drawings, tar collection occurs on the side walls toward the end wall of the cup, and until those walls are covered with tar, tar deposits tend to remain confined to the region of the cup below, or forward of, the rearward or downstream end of the baffles. In the case of filter cartridge 32, the downstream end of the baffle is identified by the reference numeral 38.

Figure 3:
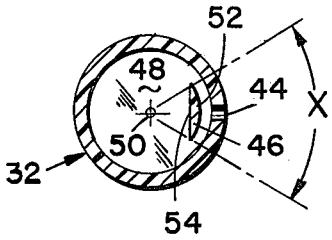
FIG. 3 is a cross-sectional view of the filter cartridge taken on line 3—3 of FIG. 2.
Figure 7:
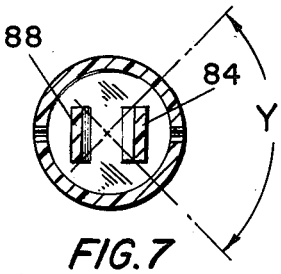
FIG. 7 is a cross-sectional view taken on line 7—7 of FIG. 6.
Figure 4:
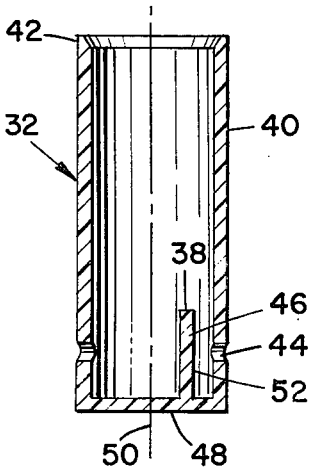
FIG. 4 is a view in vertical cross-section of the filter cartridge of FIGS. 2 and 3.
Figure 6:
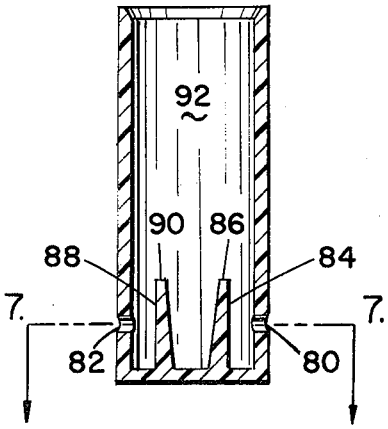
FIG. 6 is a view in vertical cross-section of still another embodiment of the invention.

The filter cartridge is shown enlarged in the cross-sectional views of FIGS. 3 and 4. Referring to those figures, the side wall 40 is cylindrical except at the open end of the cup where the wall is tapered from the inner to the outer diameter to form a rim 42 which is wedge-shaped in cross-section. The preferred cartridge is formed of a plastic material and the wedge construction of its rim makes it easier to assemble on the shank of the cigarette holder and permits upsetting of that rim to form a better seal whereby smoke is precluded from entering the interior of the cartridge except through the perforation 44. The barrier wall 46 is integrally formed with the bottom wall 48 and it extends in a direction parallel to the side walls 40 and the axis 50 of the cup. That is true at least of the forward face 52 of the barrier wall which is that face which is exposed toward the pin hole perforation 44. As explained above, some small amount of draft may be permitted in the design of that wall to facilitate production, but the amount of draft should be minimal. A greater degree of draft is permitted at the rearward face 54 of the barrier wall. In the embodiment shown, FIGS. 3 and 4, the amount of draft is negligible. In the embodiment of FIGS. 6 and 7, there is a draft at the rear face of the barrier walls.

To some extent the dimensions of the cup are limited by the diameter of cigarettes and the cigarette holder diameter that has become conventional and standard. Except for that constraint, and except that the size of the pin hole must be selected such that the unit must "feel right" when subjected to normal inhalation suction pressure, the dimensions of the cartridge and its parts are selected on the basis of discovery that certain proportions best meet the objectives of the invention.

In the preferred construction as shown in FIGS. 3 and 4, the outside diameter of the cup is 0.25 inches. The side walls are 1/32nd of an inch thick. The barrier wall is 1/32nd of an inch thick at its greatest width. The end wall 48 is between 1/16th and 1/8th of an inch thick. The cup is 0.5 inches deep. The baffle is 0.2 inches high. The perforation is formed opposite the midregion of the baffle wall and is 0.025 inches in diameter. The baffle has a width such that it occupies a segment X in FIG. 3, measured circumferentially from the central axis 50 of the cup, of 60°. That width may vary between 45° and 90°. If the barrier wall is wider, the spacing between the forward wall 52 of the barrier wall and the inner wall of the inner surface of the side wall of the cup may be increased. That spacing may vary from 0.025 inches to 0.075 inches. In the embodiment illustrated, it is 0.03 inches.

When the other dimensions fall within the ranges set out above, the inside diameter of the cup is advantageously held from 0.20 inches to 0.25 inches and the conformations of the shank which interfit with the cup to hold it in place should be such that the internal volume of the cup is not less than 0.1 cubic inches, to insure a sufficiently turbulent flow and velocity reduction to enable all of the condensate to be deposited upon the cartridge walls.

The perforation may vary from about 0.20 inches to 0.027 inches in diameter.

Figure 5:
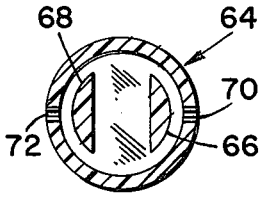
FIG. 5 is a cross-sectional view, corresponding to FIG. 3, but showing an alternative form of the invention.

In the preferred form of the invention, there is only one barrier wall and only one inlet perforation. However, the invention will work, and the objects set forth above will be achieved, if two barrier walls are provided. Such a construction is shown in the embodiment of FIG. 5 and in the embodiment of FIGS. 6 and 7. In FIG. 5 the cartridge is designated by the reference numeral 64. One of the barriers is designated 66 and the other is designated 68. They are located diametrically opposite one another. There are two inlet perforations. One of them is designated 70 and is located opposite barrier 66. The other is numbered 72 and it is located opposite barrier wall 68. The dimensions in this embodiment are like those described for the embodiments in FIGS. 3 and 4 with the exception that the area of the perforations 70 and 72 should each be reduced to half of the area of the inlet perforation 44 of FIGS. 3 and 4.

FIGS. 6 and 7 illustrate an embodiment similar to that shown in FIG. 5. Two barriers are provided. They are arranged to face diametric inlet perforations 80 and 82. This embodiment differs from that shown in FIG. 5 in that the forward face of the barrier walls, that is, face 84 of barrier 86 and face 88 of barrier 90, are flat. They lie in a plane that is perpendicular to a line that extends from the central axis 92 of the cup through a respectively associated inlet perforation 80, in the case of surface 84, and 82, in the case of surface 88. In this construction, the spacing between the forward face of the barrier and the inlet perforation is less than the separation between the side edges of the barrier wall and the interior surface of the cylindrical cup wall. That is considered to be less desirable construction because there is less resistance to flow from the space between the barrier and the side wall in the direction of the length of the barrier wall. However, in practice, tars tend to collect upon the surfaces 84 and 88 of the barrier in a manner that limits smoke flow over the top of the barrier so that an effect similar to that provided by the construction of the embodiment of FIGS. 3 and 4 is achieved within a short time after the cartridge is put into use.

Although I have shown and described certain specific embodiments of my invention, I am fully aware that many modifications thereof are possible. My invention, therefore, is not to be restricted except insofar as is necessitated by the prior art.

I claim:

1. For use with a cigarette holder of the kind having a recess at its upstream end of size to receive the end of the cigarette, a bit at its downstream end, a cavity intermediate its ends in communication with said recess, a draw passage for smoke extending through said holder from said cavity to said bit, and conformations at the wall of said cavity for retaining a filter in said cavity such that the exterior of the filter is in communication with said recess and such that the interior of said filter is in communication with said draw passage, a disposable filter comprising:

a cup having a generally cylindrical side wall and an imperforate end wall;

said side wall having a perforation formed therethrough;

a baffle wall extending at its upstream end from said end wall into the interior of said cup and spaced from said side wall and disposed such that an axial line through said perforation intersects a midregion of said baffle wall, the face of said baffle wall toward said perforation being substantially parallel with the central axis of said cup;

the surface of said baffle wall being spaced from the interior surface of the side wall of said cup a distance from 0.025 to 0.075 inches; and said cup having an interior diameter of between 0.20 and 0.27 inches and being approximately 0.5 inches long, said perforation being formed at a point approximately 0.1 inches from the bottom wall of said cup and said baffle wall extending approximately 0.2 inches from said bottom wall of said cup.

2. The invention defined in claim 1 in which said baffle wall forms a segment of a cylinder from 45° to 90° in width.

3. The invention defined in claim 1 in which said baffle is formed with a rear wall which is substantially planer and substantially coincident with the cord of the segment defined by said first mentioned surface of the baffle.

4. For use with a cigarette holder of the kind having a recess at its upstream end of size to receive the end of the cigarette, a bit at its downstream end, a cavity intermediate its ends in communication with said recess, a draw passage for smoke extending through said holder from said cavity to said bit, and conformations at the wall of said cavity for retaining a filter in said cavity such that the exterior of the filter is in communication with said recess and such that the interior of said filter is in communication with said draw passage, a disposable filter comprising:

a cup having a generally cylindrical side wall and an imperforate end wall;

said side wall having a perforation formed therethrough;

a baffle wall extending at its upstream end from said end wall into the interior of said cup and spaced from said side wall and disposed such that an axial line through said perforation intersects a midregion of said baffle wall, the face of said baffle wall toward said perforation being substantially parallel with the central axis of said cup and forming a segment of a cylinder from 45° to 90° in width;

said perforation having a diameter between 0.02 and 0.027 inches and the surface of said baffle wall being spaced from the interior surface of the side wall of said cup a distance from 0.025 to 0.075 inches;

said cup having an inside diameter from 0.20 to 0.25 inches and an inside volume of not less than 0.1 square inches;

said baffle being formed with a rear wall which is substantially planer and substantially coincident with the cord of the segment defined by said first mentioned surface of the baffle;

said cup having an interior diameter of between 0.20 and 0.27 inches and being approximately 0.5 inches long, and in which said perforation is formed at a point approximately 0.1 inches from the bottom wall of said cup and in which said baffle wall extends approximately 0.2 inches from said bottom wall of said cup.

* * * * *